United States Patent [19]

Hibbert

[11] 4,268,073

[45] May 19, 1981

[54] WINDOW LEVER LOCK

[76] Inventor: Mark W. Hibbert, 1506 11th South, Seattle, Wash. 98134

[21] Appl. No.: 57,610

[22] Filed: Jul. 16, 1979

[51] Int. Cl.[3] ..... E05C 5/02

[52] U.S. Cl. ..... 292/113; 292/DIG. 6

[58] Field of Search ..... 292/105, 113, 247, DIG. 2, 292/DIG. 6, DIG. 49, 210

[56] References Cited

U.S. PATENT DOCUMENTS

| | | | |
|---|---|---|---|
| 235,793 | 12/1880 | McCurdy | 292/105 X |
| 1,168,066 | 1/1916 | Girardot | 292/DIG. 2 |
| 3,514,142 | 5/1970 | Smith | 292/113 |
| 3,997,203 | 12/1976 | Fachbach | 292/247 |
| 3,998,481 | 12/1976 | Anthone | 292/113 X |

FOREIGN PATENT DOCUMENTS

| | | | |
|---|---|---|---|
| 1231678 | 5/1971 | United Kingdom | 292/DIG. 6 |

*Primary Examiner*—Richard E. Moore

*Attorney, Agent, or Firm*—Thomas W. Secrest

[57] ABSTRACT

This invention is a locking means for a lever-controlled, swingable glass window, such as an automobile window wing. There is a locking lever for locking the window wing in a closed position. A base member is secured to the window support and in close proximity to the locking lever. A swing member has one end portion pivoted to the base member. One part of a female-male and boss-screw combination is carried by the swing member and the other part thereof by the base member. The swing member is thus adapted to swing on top of, and be locked to, the base member in its retracted position by said boss-screw combination or to be swung into an end to end alignment with the base member to its extended position. A hook member, which includes a U-shaped member having an opening, is pivotally connected to a mid portion of the swing member. The swing member may pass through the opening in the U-shaped member as the swing member turns between its said positions. The hook member also has a detachable hook portion or a catch means of a length and shape to fit individual window locking levers to conform to sizes and shapes of individual locking levers.

10 Claims, 8 Drawing Figures

WINDOW LEVER LOCK

THE BACKGROUND OF THE INVENTION

Many automobiles are equipped with windows, such as window wings, which are swingably mounted and locked by levers to the automobile body part supporting the window opening. By the use of appropriately bent wires, such as that formed from a coat hanger, and in combination with pries, automobile thieves or thieves of the contents of automobiles, have become adept in turning levers to open such windows to gain access into the automobile. Instead of bent wires there may be used strips of meal to turn the lever and to gain access to the automobile.

This invention provides a safe and secure lock for such levers preventing access into an automobile by the turning and the unlocking of such levers by wire manipulation from the exterior of the automobile.

SUMMARY OF THE INVENTION

The invention contemplates a mechanism for locking the control lever for such swingably mounted windows by providing a base member which is secured to the automobile body, or other supporting body, and in close proximity to said control lever. The base member is pivotally connected at one end portion thereof to an end portion of a swing member. Thus, the swing member may be swung to an end-to-end aligned position between the base member and the control lever or the swing member may be swung 180° in overlying position on the base member. When the base member and the swing member are in overlying position, they may be detachably locked together by a female threaded boss carried by one of the two members and a male threaded thumb screw carried by the other member. A hook member, which includes a U-shaped portion and a detachable hook, has its open end portions pivotally connected to the swing member intermediate the length thereof and thus the swing member may turn 180° without interference by the U-shaped portion. The closed end of the U-shaped portion supports a detachable hook. Thus, a particular hook in length and shape may be used to interfit with the particular lever which is to be locked in position.

Further objects and advantages of the present invention will become explicit or implicit to one skilled in the art to which this invention pertains upon reference to the following detailed description.

DESCRIPTION OF THE DRAWINGS

A more complete understanding of this invention may be had by reference to the accompanying drawings illustrating preferred embodiments of this invention in which like reference numerals refer to like parts throughout the several views in which.

DESCRIPTION OF PREFERRED EMBODIMENTS

Figure 1:
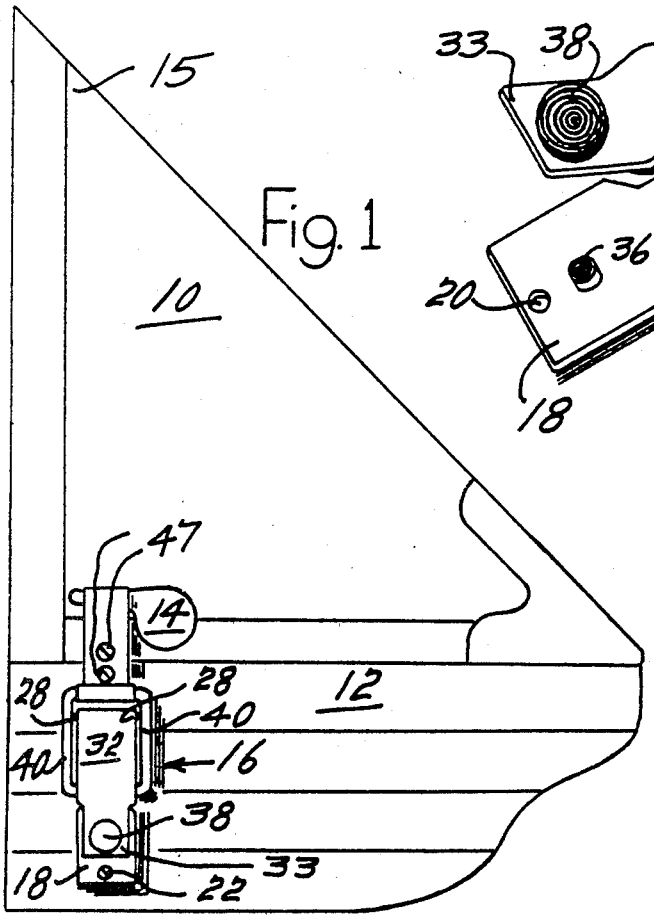
FIG. 1 is an elevational view, with the locking device in place in connection with a window wing, and with a fragment of the window supporting structure shown.

In FIG. 1, a window 10 is illustrated as swingingly mounted relative to the frame which is illustrated by frame support fragment 12. A locking lever 14 is the lever to be locked by the window lever lock of this invention which is illustrated generally by 16.

For the purpose of orientation the reader should realize that the lower part of the window 10 is near the frame support fragment 12. The apex 15 of the window 10 is at the top of the window.

Figure 2:
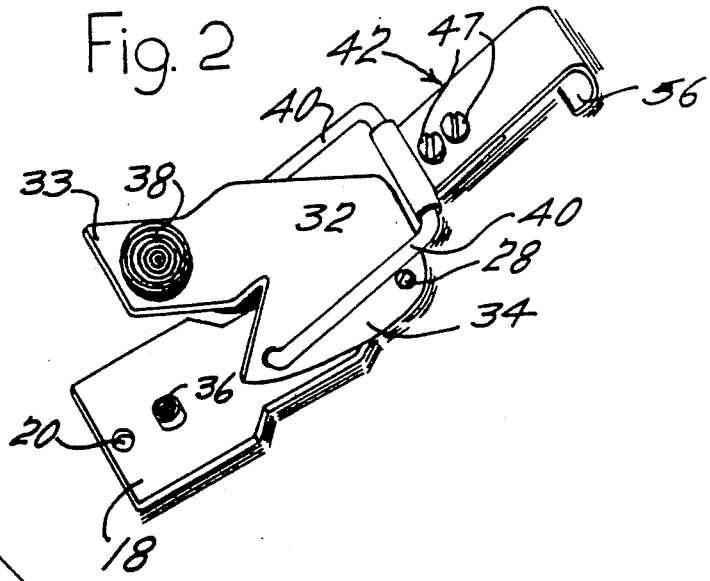
FIG. 2 is a perspective view of the locking device, detached from the supporting structure and with the parts of the device shown in a position between being fully extended and being fully retracted.
Figure 3:
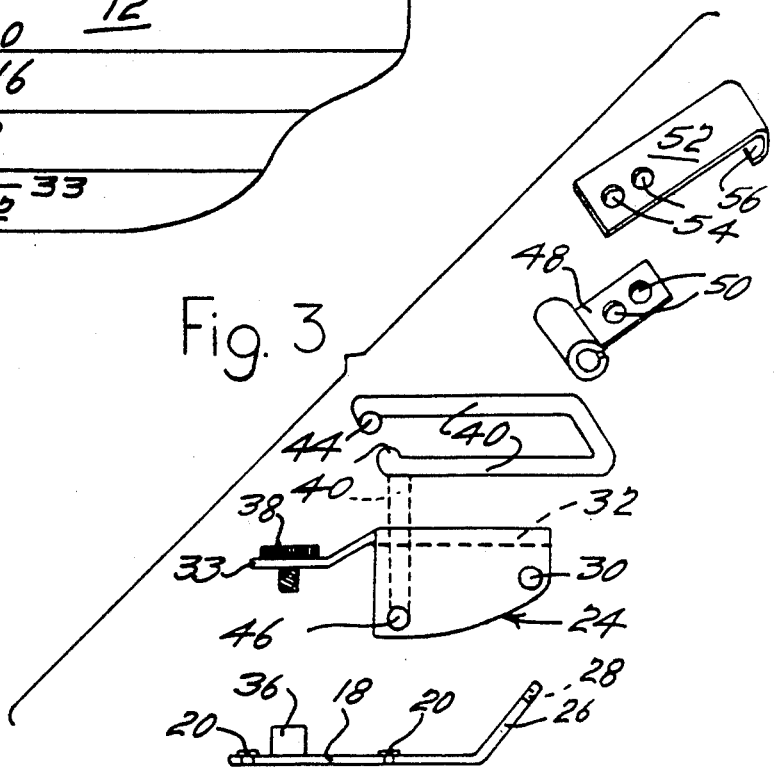
FIG. 3 is an exploded perspective view of the parts of the device shown in FIG. 2.

Now referring to FIGS. 2 and 3, a base member 18 is provided with two holes 20 so that the member 18 may be secured to the frame support 12 by metal screws 22, one of which is shown in FIG. 1. The swing member 24 is pivotally connected at one end portion thereof with an end portion of the base member 18. This may be accomplished by providing an upwardly bent portion 26, of base member 18, having laterally projecting bosses 28 thereof which interfit with holes 30 in swing member 24. Swing member 24 is U-shaped in cross section with a top plate 32 and side plates 34. The top plate 32 extends into a narrower part 33. The holes 30 in swing member 24 are in the side plates 34 thereof and at a distance below the top plate 32 and thus when the members 18 and 24 are extended, their (then) bottom surfaces may lie substantially in a common plane.

When the members 18 and 24 are superposed, one above the other, locking means are provided to maintain this position. The locking of these two members is by a combination of a threaded male screw and a mating threaded female boss, one thereof carried by the base member 18 and the other thereof carried by the swing member 24. As an example thereof, there is shown the female threaded boss 36 carried by the base member 18 and the mated male threaded thrumb screw 38 threadedly connected with the narrower part 33 of the top plate 32 of the swing member 24. The boss 36 and the screw 38 are aligned and may be threadedly engaged with each other when the swing member 24 is turned on the laterally projecting bosses 28 and is superposed and rests on the base member 18.

A hook member comprises a U-shaped member 40 and a hook means 42. The U-shaped member 40 has its legs, at the open portion of the U, turned inwardly to provide lug portions 44. These lug portions 44 are received within holes 46 in the side plates 34 of the swing member 24 and thus pivotally connect U-shaped member 40 of the hook member with the swing member 24. Because of the open center of the U-shaped member 40, the swing member 24 may turn a full 180° relative to the U-shaped member 40 without interference between such parts.

The hook means 42 of the hook member may comprise two parts secured together, as by nuts and bolts or metal screws 47. One part, a sleeve and plate 48, may have a sleeve embracing the closed end portion of the U-shaped member 40 and its plate part provided with holes 50 therein. The hook part may have a plate part 52, holes 54 therein, and hooklike portion 56 of a shape and contour to engage with the locking lever 14 and prevent the same from turning when window lever lock 14 is in locking position. By having the hook means 42 in two parts, the shape of the hooklike portion 56 or catch means 56, and the length of the plate 52 may be readily fitted to a particular locking lever 14 and the remainder of the parts of the assembly may be of a standard to fit a multiple variety of locking levers. It is to be realized that the hook means may be of unitary construction instead of integral construction.

The base member 18 is secured to the frame support 12 after a suitable location is determined relative to the locking lever 14 and with a particular plate 52 of a length and suitable conformation to the hooklike portion 56, in any suitable manner such as by use of metal screws 22. Next the swing member 24 is angularly moved as respects the base member 18 to a position of extension regarding the same. Then the hooklike portion 56 is engaged with the locking lever 14 and while such engagement continues, the swing member 24 is angularly moved about laterally projecting bosses 28 until the top plate 32 of the swing member 24 is aligned with and over the base member 18. At this time, the male threaded thumbscrew 38 will be aligned with, and may be threadedly engaged with, female threaded boss 36. The selection of the length of the plate 52 and the positioning of base member 18 has been such that the window lever lock 16 will be under tension after thrumbscrew 38 is threadedly engaged with boss 36 and thus locking lever 14 cannot be turned until the window lever lock 16 is released by unscrewing thumbscrew 38.

Figure 4:
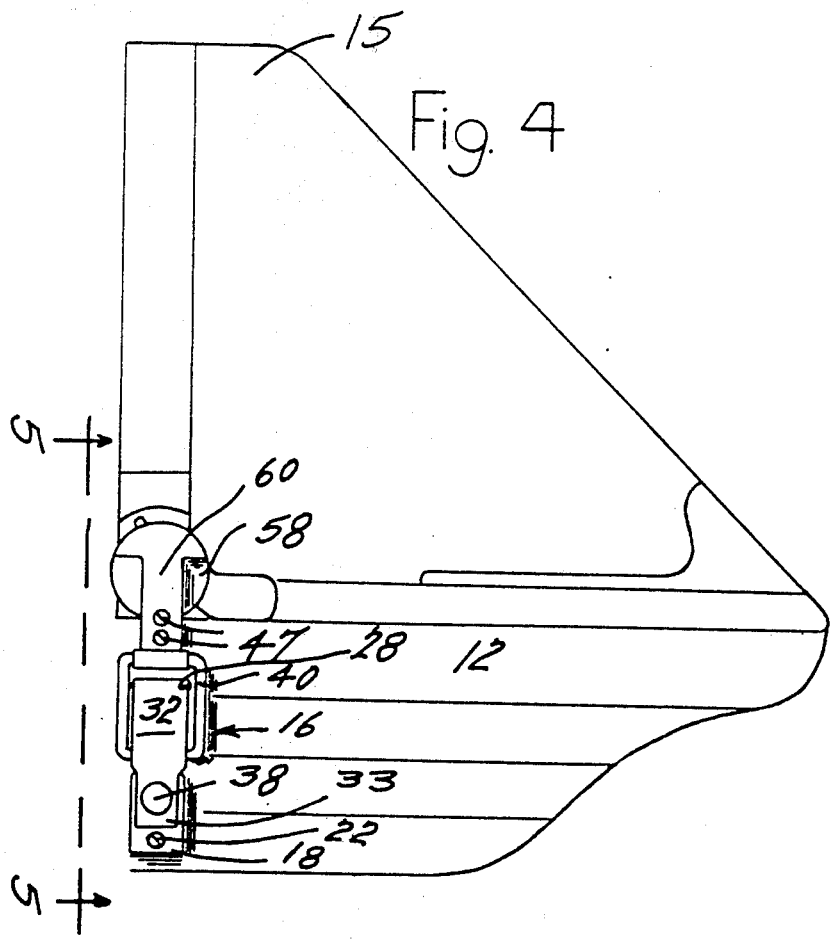
FIG. 4 is a view similar to FIG. 1 of a modified form of device in connection with a modified locking lever.
Figure 5:
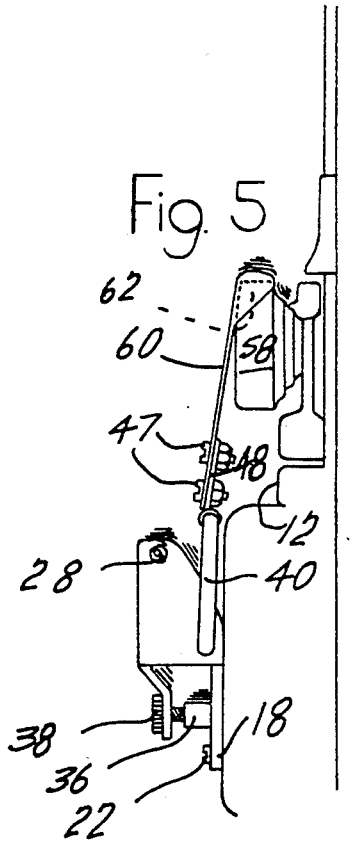
FIG. 5 is an end view taken substantially on broken line 5—5 of FIG. 4.
Figure 6:
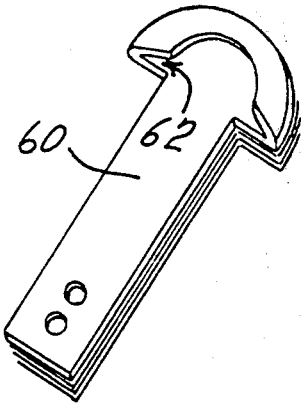
FIG. 6 is a perspective view of the hook portion or clasping portion of the device shown in FIGS. 4 and 5.

In the alternate form of this invention shown in FIGS. 4–6, inclusive, similar parts are given similar numbers and the description of the parts and their functions are incorporated by reference and without undue repetition. In addition, the locking lever 58, for the window 10, moves in a rotary direction to lock and unlock the window. Thus, the plate and hook part 60 (which replaces the plate and hook part 52 of the previous figures) terminates in a circular concavity 62, or catch means 62, which snugly mates with a portion of the external contour of the locking lever 58. When the locking lever is in retracted position and the thumbscrew 38 is engaged with the boss 36 of this construction, the frictional contact between the locking lever 58 and the circular concavity 62 of the plate and hook member 60 is such that the locking lever 58 may not be operated until the plate and hook member 60 is released and the circular concavity 62 is removed from the locking lever 58. The hook part 60 and the plate 48 may be of unitary construction istead of integral construction.

Again, in FIG. 4, the lower part of the window is near the frame support fragment 12.

Figure 7:
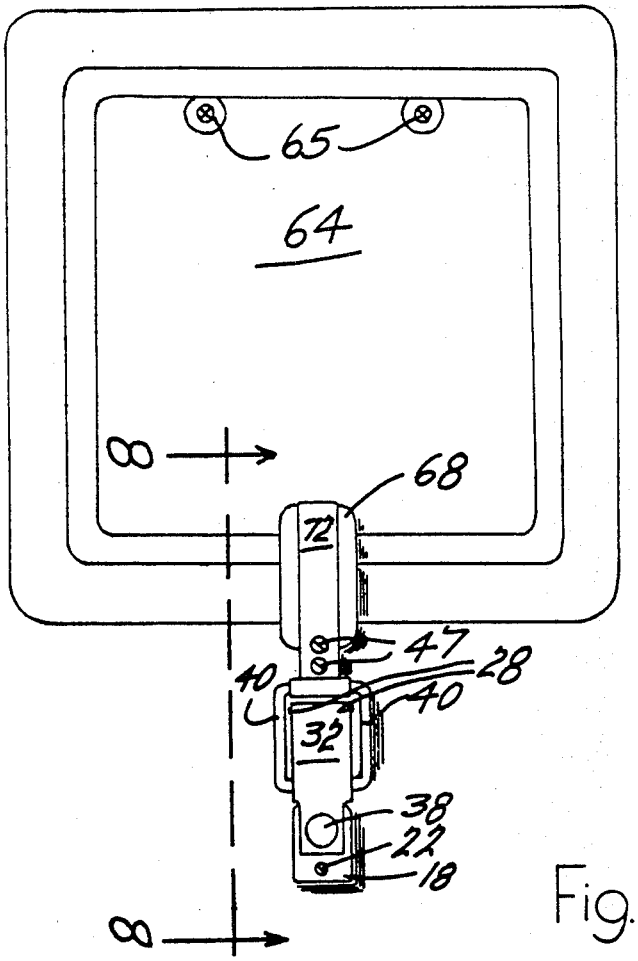
FIG. 7 is another modified form of the invention shown in connection with another type of window and window lock lever.
Figure 8:
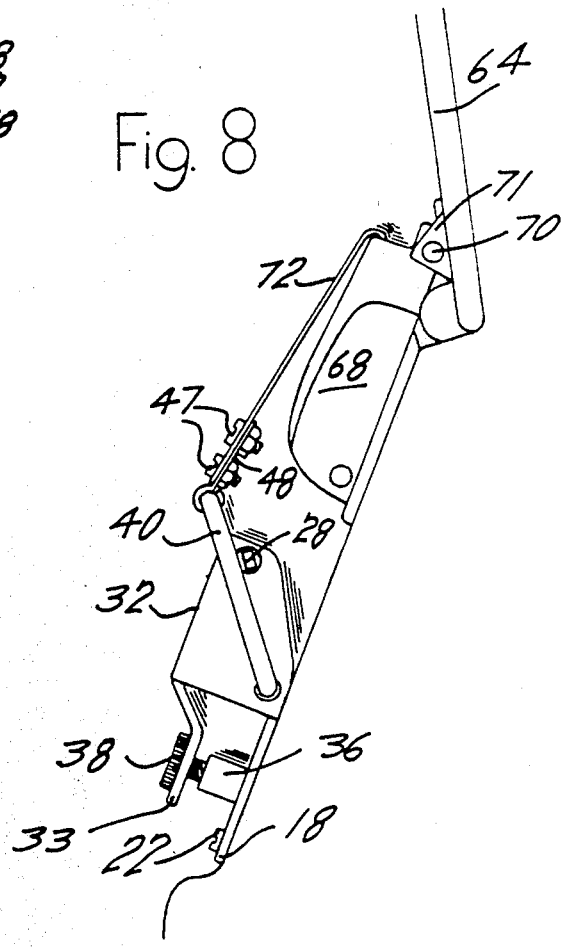
FIG. 8 is an elevational view taken substantially on broken line 8—8 of FIG. 7.

In an alternative construction of this invention shown in FIGS. 7 and 8, the window 64 has been hinged at the top rather than at the front as illustrated in the previous views, particularly, FIGS. 1 and 4. The hinge means is shown at 65. Again, in the interest of brevity, like reference numerals refer to like parts and the previous description is incorporated by reference. Also, the locking lever 68 is movable on cross shaft 70 to lock and unlock the window 64 against movement. Due to the shape of the unlocking lever 68, plate and lock portion 72 (function like portions 56 and 62 of the previous figures) is held in place by nuts and bolts or metal screws 47 in the same manner and for the same purposes as the former similar parts. The shaft 70 is positioned on a mounting bracket 71 attached to the window 64 or the frame around the window 64. On that part of the automobile surrounding the window there is positioned the base member 18. The hooklike portion 72 connects to the locking lever 68. Again, the locking lever 68 is locked in position when the boss 36 and the screw 38 are aligned and threadedly engaged with each other. The plate and lock portion 72 may be of unitary construction instead of integral construction. Plate and lock portion 72 may vary in shape with respect to varying locking levers.

BRIEF RESUME

It will now be obvious that there has been disclosed in combination with various types of lever-controlled, swingable, glass windows a base member 18 and illustrative type windows are those shown in FIGS. 1, 4, and 7. Such base members 18 may be suitably attached to the supporting structure around the windows as by screws 22. Each of these base members 18 preferably has an upwardly bent portion 26 and laterally projecting bosses 28 therefrom. Thus, the base member 18 may be fabricated by a stamping process and this is likewise true of swing member 24, the U-shaped member 40 and the hook means 42, which constitute substantially all of the present device. It is well known that stamping processes are economically desirable. The swing member 24 is formed of a top plate 32 and side plates 34 which, in section, form a substantially U-shape. Holes 30 and 46 may be stamped in the swing member 24 and thus, the laterally projecting bosses 28 engage with the holes 30 in swing member 24 to pivotally connect the swing member 24 with the base member 18 and thereby provide a pivot means. Also, the lug portions 44 of the U-shaped member 40 interfit with holes 46 in the swing member 24 and thus again a pivot connection is formed between parts produced by stamping. The swing member 24 may be secured to base 18 by mating male and female members, one thereof carried by the swing member 24 and the other thereof by the base member 18. As illustrative thereof, the female threaded boss 36 is carried by the base member 18 and the male threaded thumbscrew 38 is threadedly connected with the swing member 24. The hook member preferably comprises the U-shaped member 40 connected with the hook means 42. By having U-shaped member 40 pivotally connected with the swing member 24, the swing member 24 can relatively turn 180° as respects the U-shaped member 40. The hook means 42 comprises a sleeve and plate 48 detachably connected, as by nuts and bolts or metal screws 47, with the plate of hook part 52 of FIGS. 1 to 3, or 60 of FIGS. 4 to 6, or 72 of FIGS. 7 and 8. This permits suitable adjustment and the length and configuration of 52, 60, or 72 is fitted to a particular installation.

Obviously, changes may be made in the forms, dimensions, and arrangements of the parts of this invention without departing from the principal thereof, the above setting forth only preferred embodiments of this invention. For example, the base member 18 the swing member 24, the U-shaped member 40 and the hook means 42 may be cast as well as stamped. Further, in certain instances it may be desirable to have the plate 48, the plate 52 and the hook-like portion 56 of unitary construction instead of integral construction by means of screws.

Also, this window lever lock is not restricted to windows in automotive vehicles. It is applicable to windows in pleasure boats, airplanes and even stationary units such as dwellings.

From the foregoing and having presented my invention, what I claim is:

1. In combination with a lever and a lever-controlled, swingable, window mounted in a window support, a base member secured to the window support for said window and in close proximity to the lever; one part of a female-male boss-screw combination carried by said base member; a swing member hingedly connected with said base member; the other part of said female-male combination carried by said swing member and mounted for movement into and out of alignment for threaded engagement with said one part of the female-male combination; and a hook member pivotally connected at one end portion with said swing member and terminating at its other end portion with a catch means detachably connected with the lever of the lever-controlled window for preventing movement of said lever when connected thereto.

2. The combination of claim 1, wherein the swing member is pivotally connected at one end portion thereof to said base member and swingingly moves to a position over the base member and with the male threaded screw moved into alignment with the female threaded boss.

3. The combination of claim 2, wherein the base member carries the female threaded boss at one end portion thereof and the other end portion extends angularly upwardly and terminates in pin means pivotally connected with the swing member.

4. The combination of claim 3, wherein the swing member is U-shaped in section and the legs thereof are provided with holes to receive the pin means of the base member to pivotally interconnect the swing member with the base member.

5. The combination of claim 1, wherein hook means comprises a U-shaped member, the legs thereof at the open end being pivotally connected to the swing member and the legs at the closed end thereof being connected with hook means.

6. The combination of claim 5, wherein the hook member comprises two detachable members, one connected with the U-shaped member and the other, a catch means for engagement with the window lever.

7. The combination of claim 4, wherein the hook member comprises a U-shaped member, the legs thereof at the open end terminating in inward projections parallelling the cross bar at the closed end of the U-shaped member, and wherein said inward projections engage with holes in the legs of the U-shaped swing member to pivotally interconnect the hook member and the swing member, whereby the hook member may relatively swing substantially 180° relative to the swing member and the legs of the swing member relatively move through the center opening of the U-shaped member of the hook member.

8. The combination of claim 1, wherein the base member has an end portion lying in a common plane for securance to an automobile, has its other end portion extending angularly upwardly from said common plane, and has laterally projecting lugs at said other end portion; a hook member having laterally projecting lugs; and a U-shaped, in transverse section, swing member having its base movable into said common plane, with the side walls extending therefrom, and with a pair of holes in said side walls at each end portion thereof, the pair of holes at one end portion receiving the laterally projecting lugs of the base member and the pair at the other end portion receiving the laterally projecting lugs of the hook member.

9. The combination of claim 8, wherein the pair of holes at the other end of the side walls of the swing member are at a higher elevation than those at the one end thereof.

10. The combination of claim 9, wherein the hook member comprises a U-shaped link with the legs thereof at the open end terminating in inwardly projecting lugs which interfit with the holes at the higher elevation in the swing member and pivotally connect the swing and the plate members.

* * * * *